US006109160A

United States Patent [19]

Zanieri

[11] Patent Number: 6,109,160

[45] Date of Patent: Aug. 29, 2000

[54] BREECHBLOCK FOR AUTOMATIC OR SEMI-AUTOMATIC WEAPONS

[76] Inventor: Gianni Zanieri, Via Fratelli Rosselli, 9-50018, Scandicci, Italy

[21] Appl. No.: 08/972,179

[22] Filed: Nov. 18, 1997

Related U.S. Application Data

[63] Continuation-in-part of application No. 08/815,651, Mar. 13, 1997, Pat. No. 5,808,230.

[30] Foreign Application Priority Data

Mar. 13, 1996 [IT] Italy ..... FI96A0045

[51] Int. Cl.[7] ..... F41A 3/38

[52] U.S. Cl. ..... 89/181; 89/190

[58] Field of Search ..... 89/173, 176, 180, 89/181, 187.01, 190

[56] References Cited

U.S. PATENT DOCUMENTS

| | | | |
|---|---|---|---|
| 918,760 | 4/1909 | Mauser | 89/176 |
| 1,355,378 | 10/1920 | Bardelli | 89/190 |
| 2,509,043 | 5/1950 | Muhlemann | 89/190 |
| 2,536,997 | 1/1951 | Lippert et al. | 89/190 |
| 2,962,936 | 12/1960 | Lippert et al. | 89/190 |
| 5,259,137 | 11/1993 | Blenk et al. | 89/180 |

FOREIGN PATENT DOCUMENTS

| | | | |
|---|---|---|---|
| 597508 | 11/1925 | France | 89/176 |
| 884970 | 9/1943 | France | 89/181 |

*Primary Examiner*—Stephen M. Johnson
*Attorney, Agent, or Firm*—Abelman, Frayne & Schwab

[57] ABSTRACT

Breechblock for automatic or semi-automatic weapons provided with fixed barrel and burst-box integral with to the barrel, wherein the breechblock is provided with adjustable elastic means capable of opposing the initial displacement of the breechblock in respect of the burst-box at the moment of the firing.

4 Claims, 2 Drawing Sheets

BREECHBLOCK FOR AUTOMATIC OR SEMI-AUTOMATIC WEAPONS

This appln is a con't-in-part of U.S. Ser. No. 08/815,651 filed Mar. 13, 1997, now U.S. Pat. No. 5,808,230,

FIELD OF THE INVENTION

The present invention refers to automatic or semiautomatic weapons, in particular handguns, and to the devices used to close the burst box at the moment of the firing.

STATE OF THE ART

As it is known in automatic or semi-automatic weapons the device closing the burst-box plays a vital role and represents one of the main characteristic of the weapon. The importance of the device is due to the fact that the quality of the shooting (accuracy of fire, handiness, burst) largely results from the technical solutions adopted for its manufacturing.

The closing device is normally constituted of a breechblock slide which allows the burst box to close at the moment of the burst of the cartridge and which utilizes the energy developed by the same burst to permit the ejection of the cartridge case and the subsequent loading of a new cartridge.

Therefore, the means closing the breechblock must oppose the initial force developed by the burst of the cartridge (closing the burst-box with a force sufficient to allow the shooting of the bullet without loss of energy) but without restraining the closing mechanism, i.e. leaving the slide free to move back after the bursting in order to allow the ejection of the cartridge case and the automatic loading.

Referring now in particular to automatic or semi-automatic handguns, several solutions are possible for the restraining of the breechblock in order to obtain the desired effect i.e. delaying the opening of the burst-box immediately after the firing and the development, in the burst-box, of the highest pressure on the bullet; such solutions are represented mainly by 1) a fixed barrel with inertial mass closing;

2) a fixed barrel with inertial mass and damping pistons;

3) a mobile barrel with geometric closing or short recoil.

However, all the above said solutions present some drawbacks.

In particular the first solution, which is mechanically very simple, does not allow the use of powerful cartridge since in order to allow a good closing of the burst-box it should be necessary to use such an heavy slide that it would be practically impossible to use the weapon.

The other above reported solutions were adopted in order to overcome the above mentioned drawback but the second solution involves structural complications of the manufacturing stage with high costs and problems of maintenance while the third (mobile barrel) does not allow sufficient accuracy of fire.

OBJECT OF THE INVENTION

A first object of the present invention is to overcome the above said drawbacks by virtue of a breechblock for automatic or semiautomatic weapons, very simple and economical which allows the use of powerful cartridges also in handguns with fixed barrel.

A further object of the present invention is to allow the use, with the same weapon, of cartridges of different power, giving the user the possibility of regulating the reaction force of the breechblock in consequence to the pressure following the release of the chosen cartridge.

A still further object of the invention is to avoid the use of moving heavy masses making the use of the weapon easier.

SUMMARY OF THE INVENTION

The above said objects are reached according to the invention by a breechblock for automatic or semi-automatic weapons, particularly headguns but also rifles, submachine guns and similar, wherein the initial push of the initial pressure on the breechblock caused by the release of the cartridge is opposed by elastic means capable of opposing to the initial deplacement of the breechblock in respect of the burst-box. After the initial phase, such means allow the sliding back of the breechblock in order to perform the following phases of ejection of the cartridge case, the cocking of the striker and the loading of a new cartridge. The device comprises also a return-spring to pull the breechblock back to its starting position after it has been pushed back by the release of the cartridge.

According to a preferred form of the invention, foreseen for application to an automatic handguns provided with fixed barrel and burst-box integral with the barrel, the device consists of a cylindrical breechblock coaxial to the barrel and comprising a bottom piece capable of closing the burst-box. The breechblock presents in front the bottom a plurality of arms placed longitudinally around the barrel and which turn with an extremity on a pin fixed the bottom, while their other extremities reach on the mouth of the barrel and engages with it by locking teeth. One or more spring hooks are fixed to the external surface of the arms in order to keep them closed. At the shooting, the bottom pulls back the breechblock (under the action of the pressure due to the burst of the cartridge) so that the locking teeth are lifted on to the top of the mouth of the barrel and the arms are forced to diverge elastically deforming the spring hooks. In the initial phase the arms oppose the sliding between breechblock and burst-box.

The elastic reaction is controlled by adjusting the axial position of the spring hooks of the arms to vary the force needed to diverge the arms.

The return spring is placed in the space between the barrel and the arms and works between the burst-box external wall and the free extremity of the arms.

The first advantage is represented by the fact that the whole weight of the weapon is decreased since the usual breechblock slide is eliminated.

Moreover the described solution is very simple and economical, permits the use of cartridges of varying powers, without requiring complicated manufacturing operations.

DESCRIPTION OF THE DRAWINGS

The advantages can be better understood in the light of the attached drawings; in particular.

DETAILED DESCRIPTION OF THE INVENTION

Figure 1:
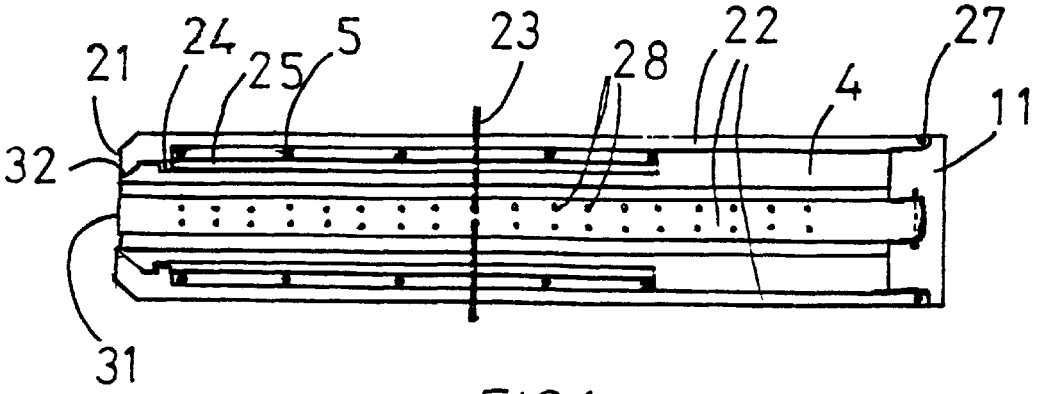
FIG. 1 is a longitudinal section view of the device according to the invention.

Referring to the attached drawings a device for automatic or semiautomatic weapons according to the invention consists of a cylindrical breechblock 1, comprising a bottom piece 11 to which three arms 22 are connected by pins 27 on which they can turn. The arms are fixed along the outward edge of the bottom at an equal distance from each other and placed longitudinally along the barrel of the weapon. The breechblock bottom 11 closes a burst-box 4, open at the back, to which is joined a barrel 3, coaxial with the burst-box 4, having a diameter equal or slightly inferior to that of the burst-box.

FIG. 1 shows the breechblock before the shooting: the bottom closes the burst-box 4 and the arms 22 are placed between the back of the burst-box 4 up to the mouth 31 of barrel 3 where each of them has an indented locking tooth 21. The teeth 21 are placed in such a way that they present a sliding incline in respect of the sloping surface 32 of the barrel mouth 31 but are on the outward of the barrel hole.

Figure 5:
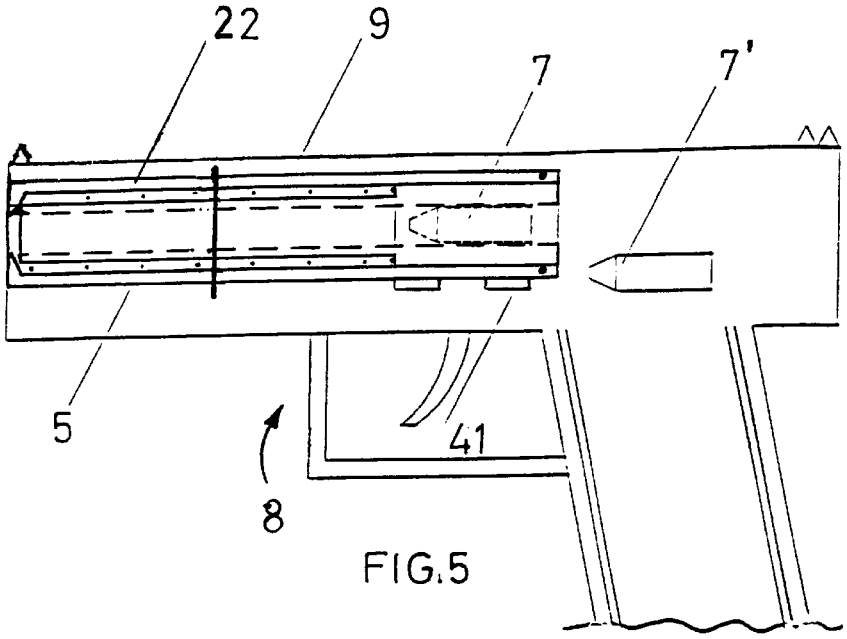
FIG. 5 is a lateral view of a weapon provided with the breechblock of the invention.

As it can be seen from the figure, in the space comprised between the outward surface of the barrel and the inner surface of the arms a coil spring 5 is placed, which works on the burst-box and on the retaining teeth 24 of the arms, which are near to the locking teeth and slide along a guide 25 realized on the external surface of the barrel. Two parallel series of blind holes 28 are aligned on the external surface of the arms. Three spring hooks 23 connect each arm to the adjacent one. The extremities of the spring hooks are inserted into axially corresponding holes 28 of the arms. FIG. 5 shows an automatic handgun 8, comprising a barrel 3 and a burst-box 4, integral to the barrel and fixed to the gun fore-end by hooks 41.

Inside the burst-box 4 there is a cartridge ready for use (the firing pin is not shown in the figure and is preferably placed in the space below the burst-box and can be driven against the breechblock by a rocker arm).

Figure 2:
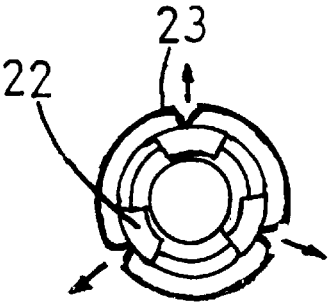
FIG. 2 is a frontal view of the device of FIG. 1.

At the shooting, the bottom of the cartridge case 7 pushes back the bottom 11 and the arms 22, which are integral to the bottom, slide back so that they pull the teeth 21 over the mouth 31. As a consequence the arms are forced to elastically deform the spring hooks 23 and to open wide. The opening of the arms is indicated by the arrows of FIG. 2.

According to the invention the initial elastic reaction of the hooks 23 is such that the burst-box 4 remains closed for a time sufficient to allow the shooting of the bullet;

immediately thereafter, when the teeth 21 are already resting on the outward surface of the barrel 3, the breechblock can slide back for the usual performing of the phases of cartridge ejection, cocking of the striker and loading of a new cartridge. In the end the breechblock 1 is driven back to its starting position by the spring 5.

According to the invention, the force needed to open the arms 22 wide, and therefore to open the burst-box, can be adjusted by axially displacing the spring hooks 23 and is decreased by moving the same far from the mouth 31.

This feature allows the use in the same gun of cartridges having different powers and for which different compensating forces are therefore necessary.

FIG. 5 shows also the outward shell 9 which covers the device described in the present invention for the sake of completeness of representation of the gun 8.

Figure 4:
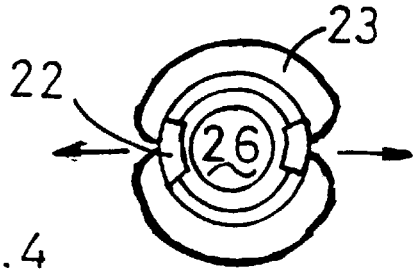
FIG. 4 is a frontal view of a second embodiment of the invention.

FIG. 4 shows a further embodiment of the invention in which only two arms 22' and two spring hooks 23' having a substantially semi-circular shape are provided. In this embodiment it is also possible to use only the upper spring hook 23' in order to facilitate the longitudinal displacement of the breechblock inside the space below the barrel and to avoid any hindrance to the following phases of cartridge ejection, cocking of the striker and loading of a new cartridge.

Figure 3B:
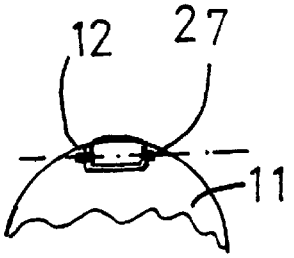
FIGS. 3*a*–3*b* show an enlarged view of a detail of the invention.
Figure 3A:
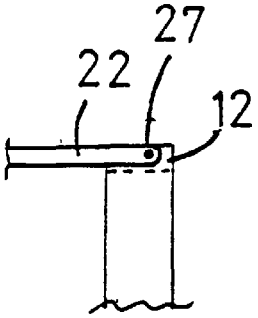

FIG. 3*a* shows a detail of the connection between arms 22,22' and bottom 11. The arms 22 can rotate on pins 27 which pass through the rear extremity of the arms and are fitted into the side walls of edge cavities 12 of the bottom 11.

It is also evident that it is possible to apply the invention in other forms, for example by making the teeth act on different fixed parts of the weapon instead of on the barrel mouth (for example the burst-box walls).

Figure 6:
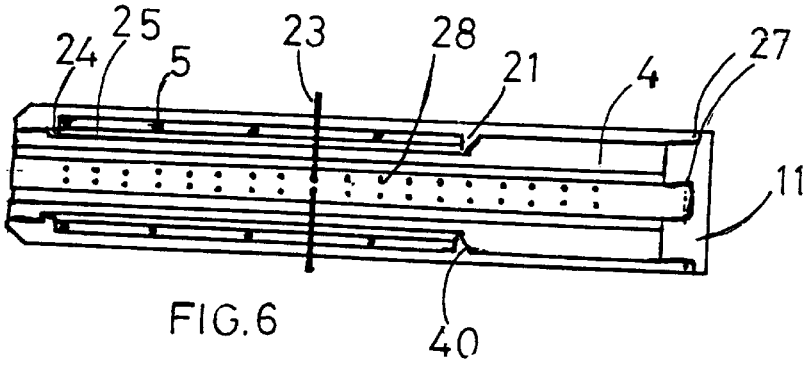
FIG. 6 is a lateral view of a further embodiment of the invention.

For example, in the embodiment of FIG. 6 the deformation of the spring hooks is due to intermediate teeth 21', acting on a sloping surface 40 made on the front wall of the burst-box 4 and capable of sliding on the burst-box after the initial opening of the arms.

Figure 7:
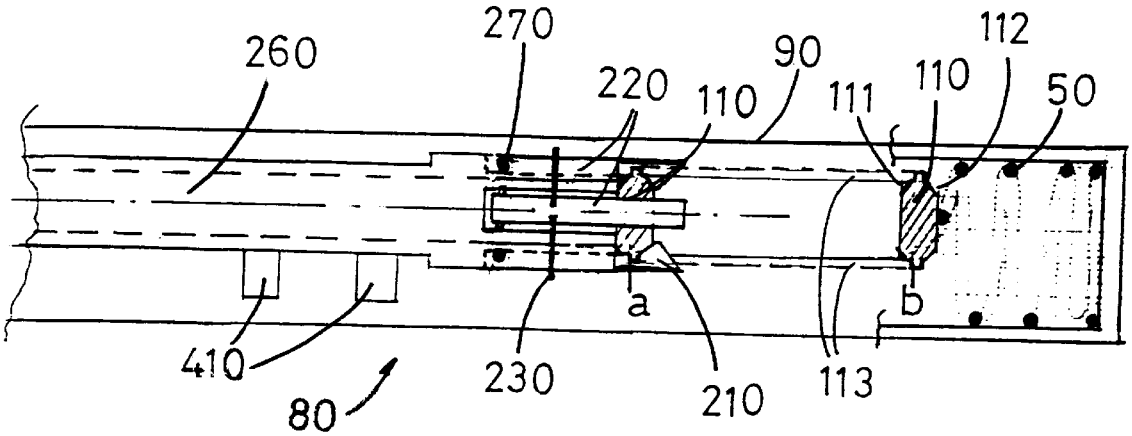
FIG. 7 is a top view of a third embodiment of the invention.

FIG. 7 schematically shows a breechblock according to the invention, particularly suitable to be applied to long barrel weapons 80, for example rifles, in which several hooks 410 fix the barrel 260 to the weapon case 90.

In this kind of weapons, the fire accuracy depends on the firmness of the barrel at shooting, and also slight vibrations deviate the bullets far from the target. In order to avoid vibrations due to the displacement of the arms, in the embodiment of FIG. 7 the arms 220 can turn on pins 270 fixed to the walls of the burst box 40 and have dual slope teeth 210 which engage with sloping surfaces 111,112 made on the front and the rear side of the breechblock bottom 110. Bottom 110 is the only movable element, and is pressed against the burst box by a return spring 50 placed between the rear side of the bottom 110 and the end wall 91 of the weapon case 90.

Spring hooks 230 are applied to and act on the arms 220 as the already described spring hooks 23 are applied to arms 220. At the firing, the arms open wide being forced to diverge by the bottom 110 which, sliding on traditional guides 113, moves from a rest position (a) to an end stroke position (b) in which the return spring is compressed and pushes the bottom 110 back to the previous starting position.

It is anyhow evident that in all the described forms of application of the invention, the free space between the arms must be such to allow the loading and the ejection of the cartridge cases. Thus, also the embodiment of FIG. 7 can be provided either with two or three arms and spring hooks according to the arrangements of the previously described embodiments.

In case of an improper regulation of the elastic reaction force (e.g. when the spring hooks position is adjusted along the arms for a cartridge having a smaller power then the cartridge actually inserted in the burst box) the breechblock bottom would open in advance of the due time. When the weapon fires, the advanced opening of the breechblock could cause an overpressure inside the burst box, instead of inside the cartridge case, which would be very dangerous for the user safety.

In order to avoid any risks, safety valves opening at a predetermined pressure level can be inserted through the burst box walls. For example, these valves are constituted by a hole (having a diameter of few millimeters, for example from 1 to 3 mm) connecting the burst box with the external and closed by a ball on which a spring exerts a predetermined force which opposes the burst box pressure.

In the present description only the parts necessary for the understanding of the invention are shown. Anyhow it is pointed out that the described device can be used for all the common automatic or semi-automatic weapons, although not described in detail, by operating the appropriated modifications of dimensions and/or materials.

I claim:

1. Breechblock device for automatic or semi-automatic weapons of the kind provided with a weapon case in to which a fixed barrel and a burst-box integral to the barrel are housed, comprising:

a bottom piece able to close the opening of the burst-box;

adjustable elastic means capable of opposing to an initial displacement of the bottom piece in respect of a starting position in which the bottom piece opens the burst-box at the moment of the firing, said elastic means comprising a plurality of arms extending parallely to the barrel and turning with an extremity on a suitable pin fixed to a portion of the burst-box, and sloping teeth built in to the arms by which the arms engage with a portion of the breechblock bottom piece which is movable in respect of the portion of the burst box;

at least a spring hook connecting each arm to the adjacent ones at a predetermined axial position in order to exert an adjustable elastic reaction force opposing to said initial displacement and to the consequent opening of the arms due to the sloping teeth engagement;

a return spring able to push the bottom piece from an end-stroke position back to a starting position where the bottom piece closes the burst box opening until the next firing.

2. Breechblock device according to claim 1, wherein said portion of the burst-box is a lateral portion of the burst-box;

said portion of the bottom piece comprises two sloping surfaces made on a front and a rear side of an external portion of the breechblock bottom;

said teeth are dual sloping teeth built on free extremities of the arms;

said return spring is a coil spring working between a rear side of the bottom and an end wall of the weapon case.

3. Breechblock device according to claim 1, wherein the spring hooks position along the arms is adjusted by inserting the extremities of the hooks into axially corresponding blind holes of the arms.

4. Breechblock device according to claim 1, comprising two arms laid on a horizontal plane the one opposite to the other, and at least a spring hook connecting the arms and placed on an upper side of the arms.

* * * * *